US005209215A

United States Patent [19]

Morrison

[11] Patent Number: 5,209,215

[45] Date of Patent: May 11, 1993

[54] FOLDING CROSSBOW STOCK

[75] Inventor: David E. Morrison, Homosassa, Fla.

[73] Assignee: Saxon International, Inc., Tarpon Springs, Fla.

[21] Appl. No.: 792,781

[22] Filed: Nov. 15, 1991

[51] Int. Cl.[5] ..... F41B 5/12

[52] U.S. Cl. ..... 124/25; 124/22; 124/88; 16/331; 42/73; 403/96; 403/102

[58] Field of Search ..... 124/25, 26, 21, 22, 124/20.1, 27, 88, 86, 23.1; 403/96, 95, 93, 92, 102; 16/331, 329; 42/73, 72, 71.01, 75.04

[56] References Cited

U.S. PATENT DOCUMENTS

| | | | |
|---|---|---|---|
| 2,441,487 | 5/1948 | Howard | 42/73 X |
| 3,739,765 | 6/1973 | Moore | 124/25 |
| 4,407,045 | 10/1983 | Boothe | 403/92 X |
| 4,501,045 | 2/1985 | Boyer | 16/331 |
| 4,543,138 | 7/1895 | Murray | 42/71.01 |
| 4,662,345 | 5/1987 | Stephens | 124/25 |
| 4,724,576 | 2/1988 | Tatematsu | 16/331 X |
| 4,735,007 | 4/1988 | Gal | 42/73 X |
| 4,926,834 | 5/1990 | Chauvin | 124/25 |
| 5,000,154 | 3/1991 | Slayton | 124/88 X |

*Primary Examiner*—Andrew V. Kundrat
*Assistant Examiner*—Harry C. Kim
*Attorney, Agent, or Firm*—Basile and Hanlon

[57] ABSTRACT

A rotatable stock for a crossbow having a barrel and a pistol grip portion is disclosed. The stock comprises a body portion and a first end on the body portion adapted to butt against a user's shoulder. A second end on the body portion is spaced distally from the first end. The stock further comprises a mechanism, located at the second end, for rotatably connecting the stock to the barrel at an end adjacent the pistol grip portion, wherein, upon actuating the rotatable connecting mechanism, the stock may be selectively rotated between an open, first locked position and a closed, second locked position.

5 Claims, 3 Drawing Sheets

FOLDING CROSSBOW STOCK

BACKGROUND OF THE INVENTION

1. Field of the Invention

The present invention relates generally to hunting bows, and more particularly to a crossbow having a stock rotatable between an open and closed position.

2. DESCRIPTION OF THE RELEVANT ART

Designers of crossbows are continually seeking new and improved systems adapted to permit ease of manufacture, as well as efficiency of storage and handling. In order to be a useful, marketable and profitable venture, such a design should allow the full range of use as does any conventionally designed crossbow, yet should also be a versatile design, simple to mass produce, package and market.

Such conventionally designed crossbows are normally manufactured with the stock and barrel as one integral unit. The manufacture of such a crossbow would essentially necessitate a dedicated facility adapted to produce only this type of crossbow. However, this dedication of resources is too costly a proposition in today's diversified and competitive business arena.

Additionally, the size and bulkiness of such crossbows make it a difficult venture for hunters to carry and transport the weapon from one location to another. Further, given the fact that different archers have different physiques, some adaptation of the archer to the particular bow is normally required. The optimum full-draw position of the bow involves the gripping of the bow with one hand and the drawing back of the string with the other until the string touches the archer's cheekbone below his sighting eye. The arm holding the bow is thus extended to establish the draw length at the correct distance forwardly from the fixed reference point constituted by the archer's cheekbone. Since the stock of the crossbow butts against the archerk's shoulder, and since different physiques have different arm lengths, the length of the stock in relation to the rest of the crossbow must accommodate the individual archer's draw.

An additional consideration concerns handicapped persons, for whom many states reserve special time during the hunting season. These persons often need a customized stock in order to operate a crossbow. However, the purchase of such a crossbow may be cost prohibitive for the person, due to the fact that the entire crossbow has to be specially manufactured when the stock and crossbow are built as one integral unit. Small bow manufacturers could not afford to produce such a customized bow for a limited market, and large manufacturers would have to charge a premium to cover the cost of the special tooling involved.

Thus, it would be desirable to provide a stock which can be rotated into a closed position in order to provide ease of carry and transport. Further, it would be desirable to provide such a stock on a crossbow which is removable and wherein a differently configured and sized stock may be substituted on the crossbow barrel, including such a stock customized for handicapped persons. In addition, it would be desirable to provide such a stock which can be manufactured in the same facility with variously sized stocks or with conventional stocks, with essentially only minor modification to the existing facilities.

SUMMARY OF THE INVENTION

The present invention addresses and solves all the problems enumerated above. The present invention comprises a rotatable stock for a crossbow having a barrel and a pistol grip portion. The stock comprises a body portion and a first end on the body portion adapted to butt against a user's shoulder. A second end on the body portion is spaced distally from the first end. The stock further comprises means, located at the second end, for rotatably connecting the stock to the barrel at an end adjacent the pistol grip portion, wherein, upon actuating the rotatable connecting means, the stock may be selectively rotated between an open, first locked position and a closed, second locked position.

BRIEF DESCRIPTION OF THE DRAWINGS

Other objects and features of the present invention will become apparent by reference to the following detailed description and to the drawings, in which.

DETAILED DESCRIPTION OF THE PREFERRED EMBODIMENTS

Figure 1:
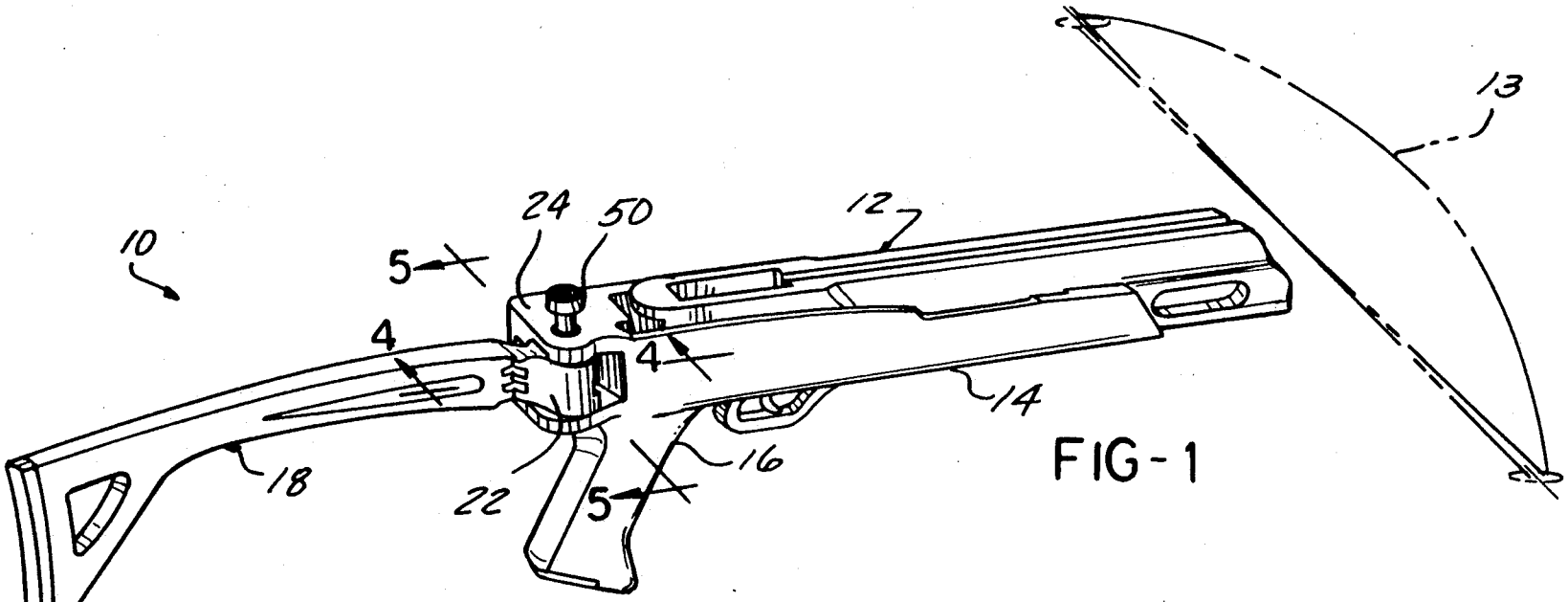
FIG. 1 is a cutaway perspective view of the present invention showing a bow in phantom and the stock in the open, first locked position.

The present invention, which can be used with all types of suitable bows having stocks, including compound bows and any type of crossbow, including pistol cross bows, is designated generally as 10. The rotatable stock 10 is for use with a crossbow 12 having a barrel 14 and a pistol grip portion 16. As seen in FIG. 1, a bow 13 is shown in phantom. The stock 10 comprises a body portion 18. A first end 20 on body portion 18 is adapted to butt against a user's shoulder. A second end 22 on body portion 18 is spaced distally from first end 20.

Figure 2:
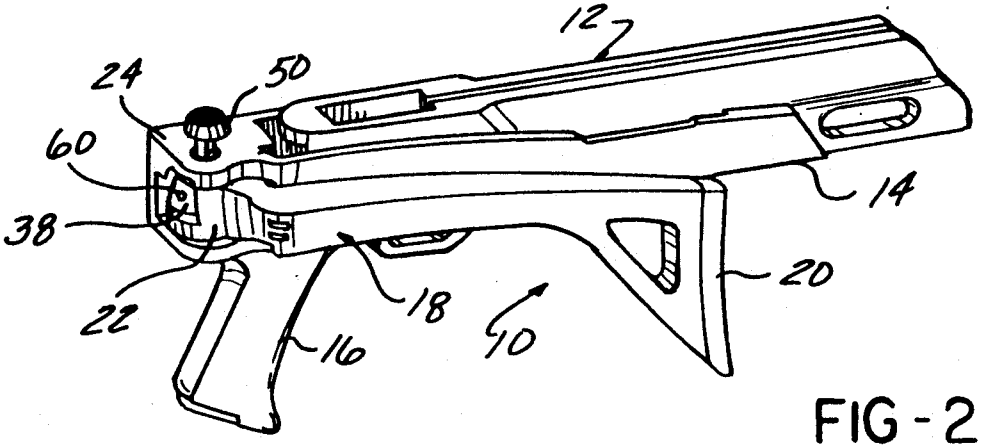
FIG. 2 is a cutaway perspective view of the present invention showing the stock rotated into the closed, second locked position.

Rotatable stock 10 further comprises means, located at second end 22, for rotatably connecting stock 10 to barrel 14 at an end 24 adjacent pistol grip portion 16. Upon actuating the rotatable connecting means, stock 10 may be selectively rotated between an open, first locked position as shown in FIG. 1 and a closed, second locked position as shown in FIG. 2.

The rotatable connecting means may comprise any suitable means, but in the preferred embodiment, this means comprises an opening 26 defined in barrel end 24, opening 26 having an upper wall 28 and a lower wall 30, relative to the position of cross bow 12 when in use, opening 26 further being shaped to removably and rotatably receive stock second end 22. The rotatable connecting means further comprises a first slot 32 defined in second end 22, with first slot 32 being open at an upper end 34 and having a bottom wall 36.

Figure 3:
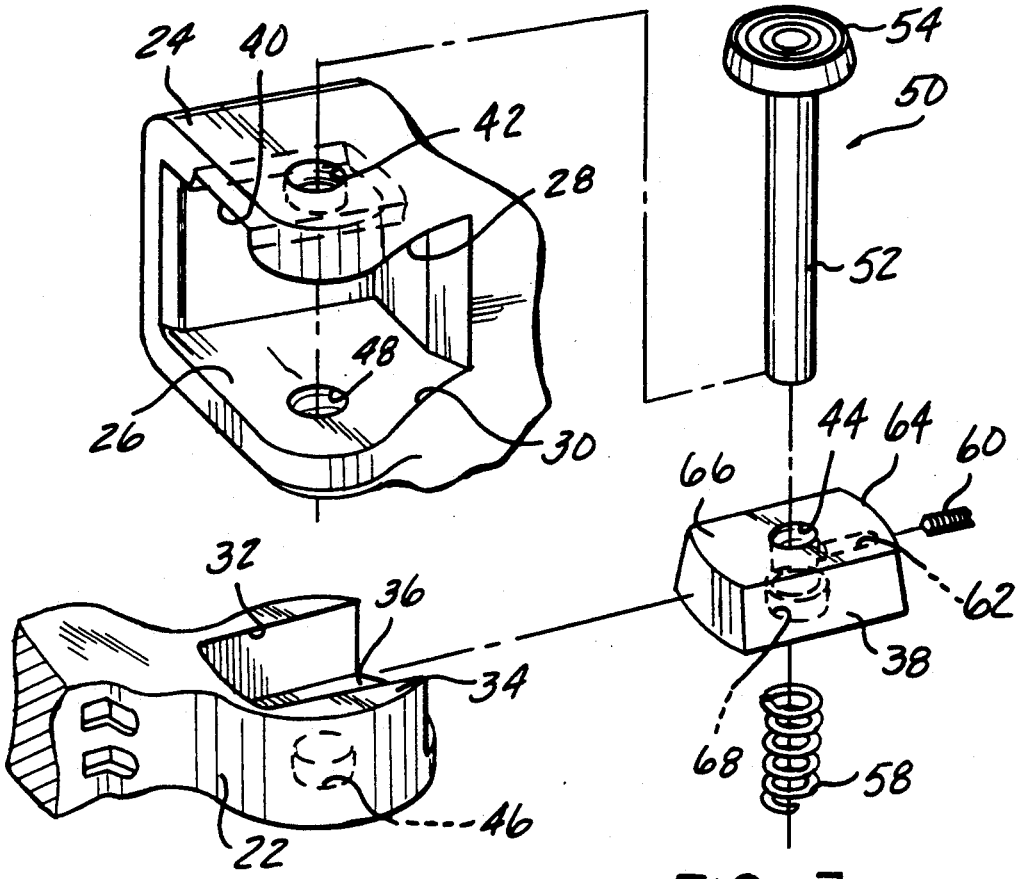
FIG. 3 is an enlarged, exploded, cutaway, perspective view showing the rotatable stock connecting means.

The rotatable connecting means further comprises means, receivable within opening 26 and first slot 32, for selectively and releasably locking the stock 10 in position. This selective and releasable locking means may comprise any suitable means, however, in the preferred embodiment, the selective and releasable locking means comprises a member 38 receivable within first slot 32. A second slot 40 is defined in barrel opening upper wall 28, second slot 40 being adapted to receive an upper portion of member 38 when stock 10 is connected to barrel 14. A through bore 42 is defined in the opening upper wall 28. A through bore 44 is defined in member 38, as best seen in FIG. 3. A through bore 46 is defined in the slot bottom wall 36, and a through bore 48 is defined in the opening lower wall 30. The selective and releasable locking means further comprises a knob 50 having a shaft portion 52 and a button portion 54. Shaft portion 52 has an indentation 56 and is receivable through the upper wall through bore 42, the member through bore 44, the slot through bore 46, and the opening lower wall through bore 48, respectively. Means are provided for biasing knob 50 in an upward position. This biasing means may comprise any suitable means, but in the preferred embodiment, this biasing means comprises a spring 58, located on shaft 52 and between member 38 and slot bottom wall 36.

Means may further be provided for positioning the biasing means. This positioning means may comprise any suitable means, but in the preferred embodiment, this positioning means is an indented and inwardly extending flange-like portion 68 in member 38, extending around the lower portion of through bore 44 and adapted to seat the upper edge of spring 58.

The selective and releasable locking means may further comprise means for retaining knob 50 in one position relative to member 38. This knob retaining means may also comprise any suitable means, but in the preferred embodiment, this means comprises a tension screw 60 threadingly receivable through a threaded aperture 62 defined in member 38, aperture 62 extending from an outer end 64 of member 38 to the member through bore 44, the tension screw further being receivable within shaft indentation 56, as best seen in FIG. 4.

Figure 5:
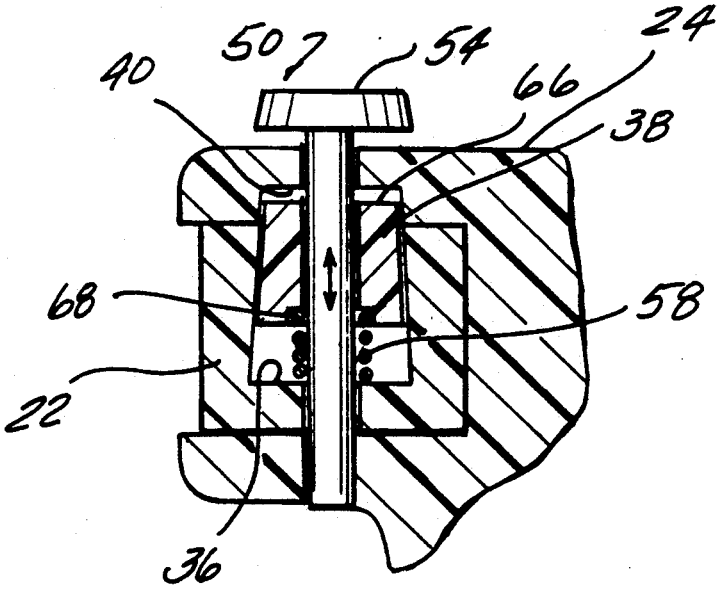
FIG. 5 is a cross sectional view taken on line 5—5 of FIG. 1.

The selective and releasable locking means may still further comprise means for retaining member 38 within first slot 32. This member retaining means may comprise any suitable means, but in the preferred embodiment, this means comprises member 38 and first slot 32 each having a wedge shape, as best seen in FIG. 5. Spring 58 will bias knob 50 in an upward direction, and will also force member 38 in an upward direction. However, due to the wedge shape of both member 38 and first slot 32, spring 58 will push knob 50 and member 38 upward only to the point where the outwardly sloping portion of wedge shaped member 38 can no longer pass freely beyond the inwardly extending portion of the wedge shape of slot 32. Additionally, second slot 40 in opening upper wall 28 may be of a wedge shape complementary to the wedge shape of member 38 in order to better receive an upper portion of member 38 when in a wedge shape.

Figure 6:
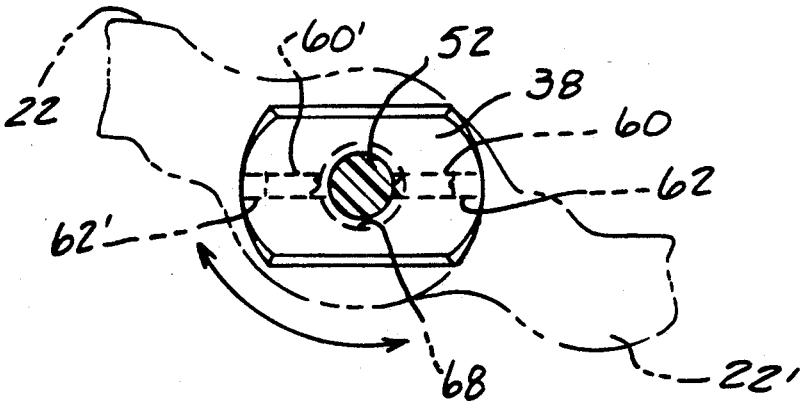
FIG. 6 is a top view of the rotatable stock connecting means with the button portion of the locking knob removed, showing a cutaway portion of the stock in phantom and the wedge shaped member, in the open and closed positions.
Figure 4:
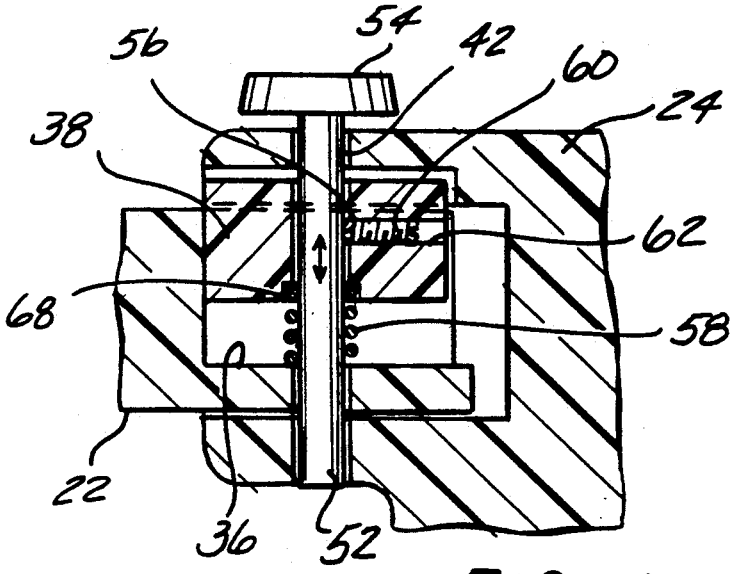
FIG. 4 is a cross sectional view taken on line 4—4 of FIG. 1.

Referring now more particularly to FIGS. 4–6, the stock 10 rotates in the following way. Knob 50 may move in an upward or a downward direction, as shown by the directional arrows in FIGS. 4 and 5. These Figures show stock 10 in an open, first locked position. Upon depressing knob 50, stock 10 may be rotated from this first locked position to a closed, second locked position, as shown in FIG. 2. When knob 50 is depressed, member 38 will be forced down into slot 32 until the upper surface 66 of member 38 is out of second slot 40 and fully within first slot 32 At this point, end 20 of stock 10 may be moved such that stock 10 rotates from an open to a closed position. During the rotation, and in between the two locked positions, stock 10 will freely rotate until it reaches either of the open or closed positions. At either of those points, spring 58 within member 38, will force member 38 up into second slot 40, thereby firmly locking the stock in place until knob 50 is once again depressed.

FIG. 6 shows the position of member 38 and threaded aperture 62 in both the open and closed positions. In the open position, second end of body portion 18 is shown in phantom and designated as 22. The threaded aperture is facing inwardly toward barrel 14 and is designated as 62. The tension screw is threadingly engaged within threaded aperture 62 and is designated as 60. When stock 10 is rotated into the closed position, the second end of body portion 18 is shown in phantom and designated as 22'. The threaded aperture is facing outward and away from barrel 14 and is shown in phantom and designated as 62'. The tension screw is also shown in phantom threadingly engaged within threaded aperture 62' and is designated as 60'.

Stock 10 may be quickly and easily disconnected from barrel 14 in the following way. When stock 10 is in the fully closed and locked position as shown in FIG. 2, tension screw 60 may be removed, knob 50 pulled upward and outwardly, and stock 10 pulled completely out of opening 26. The stock may be reconnected to barrel 14 by following the same steps but in reverse order.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A rotatable stock for a crossbow having a barrel and a pistol grip portion, the stock comprising:

a body portion;

a first end on the body portion adapted to butt against a user's shoulder;

a second end on the body portion spaced distally from the first end; and means, located at the second end, for rotatably connecting the stock to the barrel at an end adjacent the piston grip portion, wherein the rotatable connection means comprises:

an opening defined in the barrel end, the opening having an upper wall and a lower wall, relative to the position of the crossbow when in use, and being shaped to removably and rotatably receive the stock second end;

a first slot defined in the second end, with the first slot being open at an upper end and having a bottom wall; and means, receivable within the opening and the first slot, for selectively and releasably locking the stock in position, wherein the selective and releasable locking means comprises:

a member receivable within the first slot;

a second slot defined in the barrel opening upper wall, adapted to receive an upper portion of the member when the stock is connected to the barrel;

a through bore defined in the opening upper wall;

a through bore defined in the member;

a through bore defined in the slot bottom wall;

a through bore defined in the opening lower wall;

a knob having a shaft portion and a button portion, the shaft portion having an indentation and being receivable through the upper wall through bore, the member through bore, the slot through bore and the opening lower wall through bore, respectively;

means for biasing the knob in an upward position;

means for retaining the knob in one position relative to the member; and means for retaining the member within the first slot;

wherein, upon actuating the rotatable connecting means, the stock may be selectively rotated between an open, first locked position and a closed, second locked position.

2. The rotatable stock as defined in claim 1 wherein the biasing means comprises a spring, located on the shaft and between the member and the slot bottom wall.

3. The rotatable stock as defined in claim 1 wherein the knob retaining means comprises a tension screw threadingly receivable through a threaded aperture defined in the member, the aperture extending from an outer end of the member to the member through bore, the tension screw receivable within the shaft indentation.

4. The rotatable stock as defined in claim 1 wherein the member retaining means comprises the member and the first slot each having a wedge shape.

5. A rotatable stock for a crossbow having a barrel and a piston grip portion, the stock comprising:

a body portion;

a first end on the body portion adapted to butt against a user's shoulder;

a second end on the body portion spaced distally from the first end;

an opening defined in an end of the barrel adjacent the piston grip portion, the opening having an upper wall and a lower wall, relative to the position of the crossbow when in use, and being shaped to removably and rotatably receive the stock second end;

a first wedge shaped slot defined in the second end, with the slot being open at an upper end and having a bottom wall;

a wedge shaped member receivable within the first wedge shaped slot;

a second wedge shaped slot defined in the barrel opening upper wall, adapted to receive an upper portion of the wedge shaped member when the stock is connected to the barrel;

a through bore defined in the opening upper wall;

a through bore defined in the wedge shaped member;

a through bore defined in the slot bottom wall;

a through bore defined in the opening lower wall;

a knob for releasably locking the stock into position, the knob having a shaft portion and a button portion, the shaft portion having an indentation and being receivable through the upper wall through bore, the wedge shaped member through bore, the slot through bore and the opening lower wall through bore, respectively;

a spring, located on the shaft and between the wedge shaped member and the slot bottom wall, for biasing the knob in an upward position; and a tension screw threadingly receivable through a threaded aperture defined in the wedge shaped member, the aperture extending from an outer end of the wedge shaped member to the wedge shaped member through bore, the tension screw receivable within the shaft indentation and adapted to retain the knob in one position relative to the wedge shaped member;

wherein, upon depressing the knob, the stock may be selectively rotated between an open, first locked position and a closed, second locked position.

* * * * *